US005400757A

United States Patent [19]

Ishibashi et al.

[11] Patent Number: 5,400,757

[45] Date of Patent: Mar. 28, 1995

[54] FUEL INJECTION CONTROL DEVICE

[75] Inventors: Miyoshi Ishibashi; Shiochiro Miyata, both of Iwata, Japan

[73] Assignee: Sanshin Kogyo Kabushiki Kaisha, Hamamatsu, Japan

[21] Appl. No.: 94,365

[22] Filed: Jul. 20, 1993

[30] Foreign Application Priority Data

Jul. 24, 1992 [JP] Japan ..... 4-217342

[51] Int. Cl.[6] ..... F02M 51/00; H01H 47/00; F02D 41/32

[52] U.S. Cl. ..... 123/490; 361/152

[58] Field of Search ..... 123/478, 480, 490; 361/152, 154

[56] References Cited

U.S. PATENT DOCUMENTS

| | | | |
|---|---|---|---|
| 4,176,627 | 12/1979 | Bassi | 123/490 |
| 4,372,273 | 2/1983 | Harper | 123/490 |
| 4,516,185 | 5/1985 | Culligan et al. | 361/154 |
| 4,546,403 | 10/1985 | Nielsen | 361/154 |
| 4,576,135 | 3/1986 | Johnson | 123/490 |
| 4,628,885 | 12/1986 | Ogburn et al. | 123/490 |
| 4,631,628 | 12/1986 | Kissel | 123/490 |
| 4,753,207 | 6/1988 | Wright | 361/154 |
| 4,764,840 | 8/1988 | Petrie et al. | 361/154 |
| 4,884,160 | 11/1989 | Pasquarella | 361/154 |
| 5,267,545 | 12/1993 | Kitson | 123/490 |

*Primary Examiner*—Andrew M. Dolinar
*Assistant Examiner*—Thomas N. Moulis
*Attorney, Agent, or Firm*—Knobbe, Martens, Olson & Bear

[57] ABSTRACT

An electrical supply and switching circuit for the electrical fuel injectors of a fuel injection engine wherein a separate voltage supply circuit is provided for both the control circuit and driver circuit to minimize the effects of noise.

5 Claims, 2 Drawing Sheets

FUEL INJECTION CONTROL DEVICE

BACKGROUND OF THE INVENTION

This invention relates to a fuel injection control device for an internal combustion engine and more particularly to an improved electrically operated fuel injection system for such engines.

The use of electrically operated fuel injectors for internal combustion engines is being widely accepted. The use of fuel injection and particularly that having electrical control permits more accurate control of the fuel air ratio under all running conditions and thus can offer both improvements in fuel economy and exhaust emission control.

Conventionally electrically operated fuel injectors employ an injection valve that is energized by an electrical solenoid so as to control the initiation of fuel injection and the timing of fuel injection by switching the solenoid. The solenoid is normally operated by a driver circuit which is controlled by a control circuit that provides a control signal to the driver circuit so as to energize and deenergize the solenoid of the fuel injector. In most applications, the control circuit and the driver circuit are supplied with electrical power from a power source such as a battery.

It is desirable to insure control of the voltage and power supplied to the circuits and for these purposes there are normally incorporated an electrical source circuit that provide a controlled voltage to the arrangements, However, with most conventional arrangements the electrical source circuit supplies the controlled voltage to both the control circuit and the driver circuit. This type of prior art arrangement is shown schematically in FIG. 1 and will now be described by reference to that Figure.

This may be seen in FIG. 1, there is provided a fuel injection control circuit for actuating a plurality of fuel injectors and specifically the solenoid actuating coils 11*a*, 11*b*, etc., therefore. The system is supplied from electrical power from a battery, indicated schematically at 12. The battery has one of its terminals connected to a control circuit, indicated schematically 13 which includes a constant voltage supply circuit 14 that outputs a constant voltage power source to a CPU 15 which, in turn, outputs control signals to a driver circuit, indicated generally by the reference numeral 16. The CPU also receives data from engine and/or ambient sensors to determine the appropriate timing and duration of fuel injection. These control signals are transmitted over conductors 16*a*, 16*b*, 16*c*, 17*a*, 17*b*, etc.

The driver circuit, in turn, has a control circuit that is powered by the constant voltage supply circuit 14 of the control circuit 13 as via a conductor 18 and switches a plurality of switching circuits 19*a*, 19*b*, etc., in response the control output signals from the CPU 15 with the control circuit indicated generally by the reference numeral 21. The switching circuit 19*a* alternately completes the circuit through the solenoids 11*a*, 11*b*, etc., of the fuel injectors for causing their operation. The injectors 11*a*, 11*b*, etc., are all supplied with voltage with the battery 12 through a line 22 which is common for all injectors as is the return line to the battery 22 which return line is indicated by the reference numeral 23 and also provides the return from the controller 21 and CPU 15.

Although this type of prior art circuit has the advantages of simplicity, there are number of difficulties with it that adversely affect the performance. First, since the control circuit 13 and the driver circuit 16 are powered by the same constant voltage supply 14, the noise of the driver circuit 16 is transferred to the control circuit 13 and the control circuit 13 may, therefore, misfunction. Also, since the electric voltage from the supply circuit 14 is supplied to the driver circuit 16 the driver circuit 16 must be designed so as to accurately actuate each injector and this can provide problems in circuit design. Also since the control lines 22 and 23 for the injectors 11*a*, 11*b* are common, this also tends to cause noise between the various injectors with attendant possible malfunctioning.

It is, therefore, a principle object of this invention to provide an improved, simplified and yet highly effective control device for electrically operated fuel injectors for an internal combustion engine.

It is a further object of this invention to provide an electrical control circuit for a fuel injection system for an engine that will be more accurate and minimize the likelihood of misinjection due to noise in the electrical circuitry.

SUMMARY OF THE INVENTION

This invention is adapted to be embodied in a fuel injection control and driver circuit for an electrically operated fuel injector for an internal combustion engine comprised of a battery, a control circuit for providing a control signal for the operation of the fuel injector and a driver circuit for providing the electrical power for operating the fuel injector. The driver circuit is switched by the control circuit. In accordance with the invention, a first electrical power source circuit is connected directly between the battery and the control circuit to provide a controlled source of electricity for the control circuit and a second electrical power source is connected directly between the battery and the driver circuit for providing electric power to the driver circuit.

DETAILED DESCRIPTION OF THE PREFERRED EMBODIMENTS OF THE INVENTION

Figure 3:
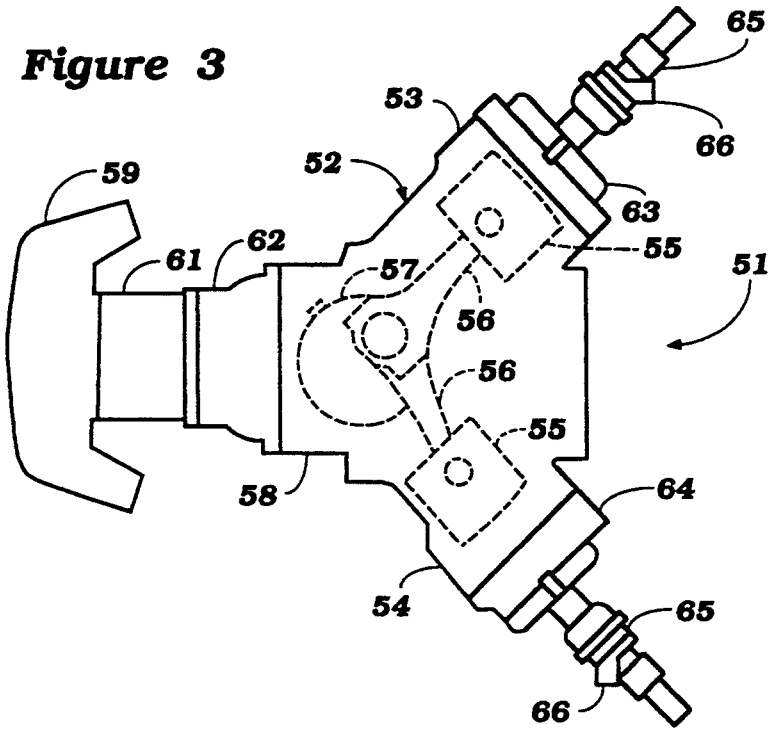
FIG. 3 is a top plan view of an internal combustion engine having a fuel injection control system embodying the invention.
Figure 1:
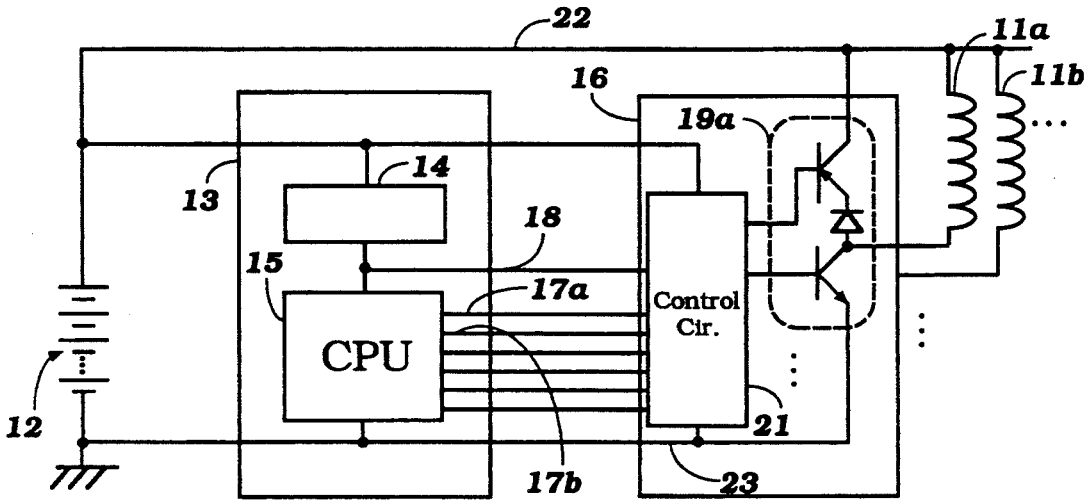
Figure 1 Prior Art
FIG. 1 is schematic showing of the fuel injection control system of the prior art type of construction.
Figure 2:
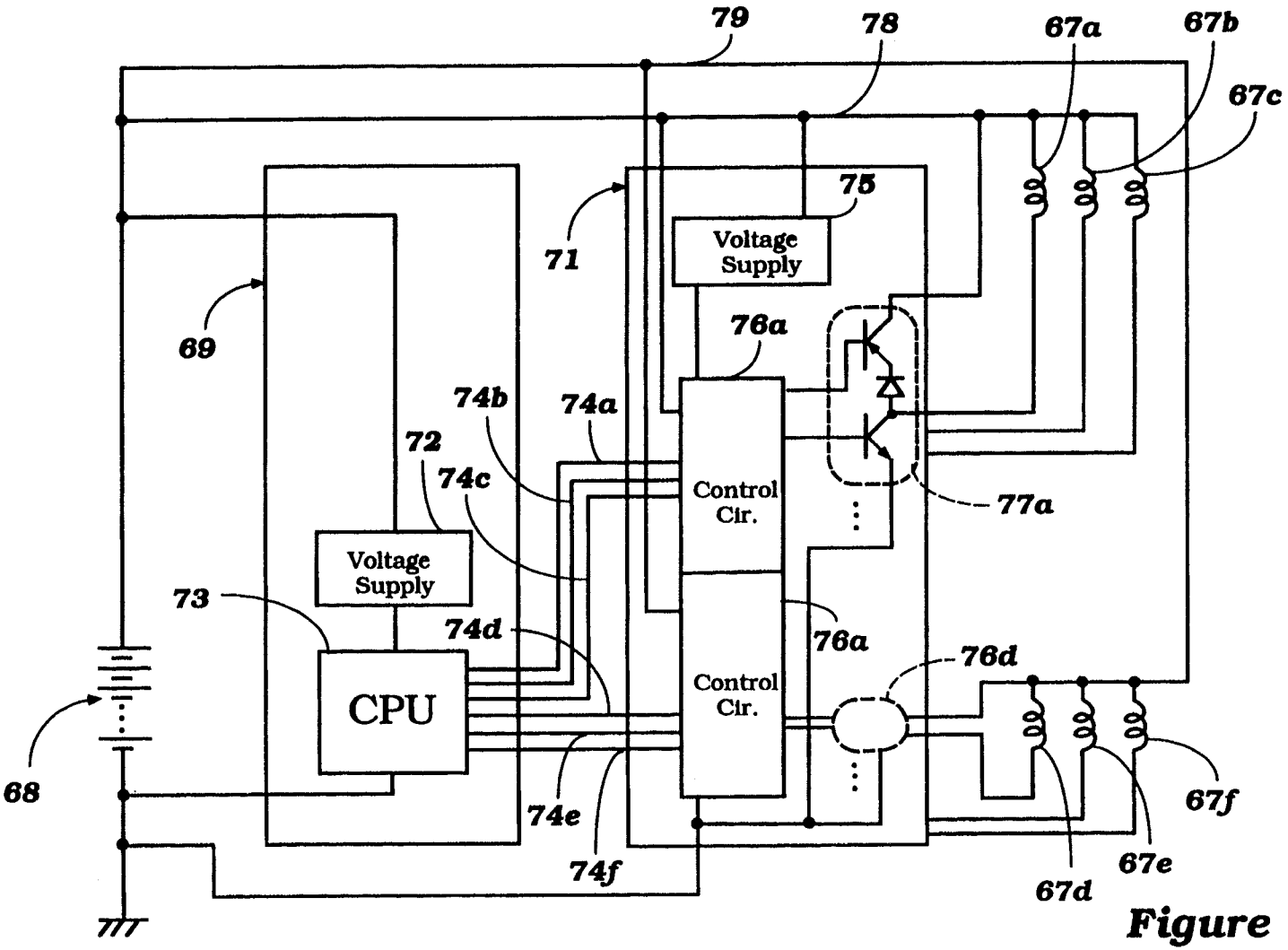
FIG. 2 is a schematic view showing the fuel injection control system constructed in accordance with an embodiment of the invention.

Before describing in detail the circuitry of FIG. 2, a description of the associated engine, indicated generally by the reference numeral 51 and shown in top plan view in FIG. 3 is believed to be appropriate. The engine 51 shown in FIG. 3 is a V6, two cycle, crankcase compression engine as employed conventional in marine outboard drive such as an outboard motor or the like. Although the invention is described in conjunction with V6 types of engines and two cycle engines, it should be understood that the invention may be employed with other types of engines and engines having other configurations.

The engine 51 includes a cylinder block 52 that has a pair of angularly disposed cylinder banks 53 and 54 each of which is formed with three aligned cylinder bores in which respective pistons 55 reciprocate. The pistons 55 are connected by respective connecting rods 56 to the throws of a crankshaft 57 that is rotatably journaled within a crankcase chamber formed by a crankcase member 58 that is affixed to the cylinder block in any know manner. As is conventional with two cycle crankcase compression engines, the individual crankcase chambers associated with each of the cylinder bores are sealed from each other.

An intake air charge is delivered to the crankcase chambers from an air inlet device 59 which may also serve a silencing function. This delivers the air charge to a throttle body 61, which in turn, delivers the charge to the crankcase chambers through an intake manifold 62 in which reed type check valves are provided so as to permit flow into the crankcase chambers but preclude reverse flow when the charge is being compressed therein. This air charge is then transferred to combustion chambers formed by cylinder heads 63 and 64 that are affixed to the cylinder banks 53 and 54, respectively, the cylinder bores and the heads of the pistons 55 through conventional scavenge passages.

Fuel injectors, indicated by the reference numeral 65 are mounted in the cylinder heads 63 and 64 and inject a fuel charge into the combustion chambers aforenoted. Electrical terminal 66 on the fuel injector 65 supply electrical power to the solenoid windings 67*a*, 67*b* and 67*c* of the cylinder bank 53 and 67*d*, 67*e* and 67*f* of the cylinder head bank 54 as shown in FIG. 2.

Spark plugs (not shown) mounted in the cylinder head 63 and 64 fire the charge at the appropriate time and an exhaust system discharges the spent charge from the combustion chambers. Further details of the construction of the engine are not believed to be necessary to permit those skilled in the art to practice the invention and the invention may be used with any type of engine, as aforenoted.

Referring now to the detail to the circuit of FIG. 2, a battery, indicated generally by the reference numeral 68 supplies electrical power to a control circuit, indicated generally by the reference numeral 69 and a driver control circuit, indicated generally by the reference numeral 71. The control circuit 69 includes a voltage supply circuit 72 which receives current from the battery 68 and provides a constant voltage source to a CPU 73. The CPU 73 outputs control signals to the driver control circuit 71 through conductors 74*a, b, c, d, e* and *f*.

The driver control circuit 71 includes its own voltage supply circuit, indicated generally by the reference numeral 75 that has its own independent connection to the battery 68. This constant voltage supply from the voltage supply 75 is provided to a pair of control circuits 76*a* and 76*b* one for each cylinder banks 53, 54 of the engine. These control circuits operate various switching circuits 77*a* . . . 76*d* . . . for switching the circuits through the fuel injectors solenoid windings 67*a* through 67*f*. It should be noted that the solenoids 67*a*, 67*b* and 67*c* of one cylinder bank are provided with a direct electrical connection 78 to the battery 68 and a separate electrical connection 79 supplies the solenoids 67*d*, 67*e* and 67*f* of the other cylinder bank. Separate return connections to the battery may also be provided. Alternatively to supplying one source line for each bank of the engine, each fuel injector may be supplied with its own source line or alternatively paired lines may be provided.

It should be readily apparent from this description that the use of the separate voltage supply 72 and 75 for the control circuit 69 and driver control circuit 71 will minimize noise in the circuit and permit a much more accurate control over the fuel injectors.

Of course, the foregoing description is that of preferred embodiments of the invention and various changes and modifications may be made without departing from the spirit and scope of the invention, as defined by the appended claims.

What is claimed is:

1. A fuel injection control and drive circuit for an electrically operated fuel injector for an internal combustion engine comprising a battery, a control circuit for providing a control signal for the operation of said fuel injector, a driver circuit for providing the electrical power for operating said fuel injector, said driver circuit being switched by said control circuit, a first electrical power source circuit connected directly to said battery to provide a controlled source of electricity for said control circuit, and a second electrical power source circuit connected directly to said battery and separately from said first electrical power source circuit for providing electrical power to said driver circuit without influence from said first electrical power source circuit.

2. A fuel injection control and drive circuit for an electrically operated fuel injector as set forth in claim 1 wherein the driver circuit switches a supply of direct electrical power from the battery to the fuel injector.

3. A fuel injection control and drive circuit for an electrically operated fuel injector as set forth in claim 2 wherein there are provided a plurality of fuel injectors and the driver circuit has a separate switching circuit for each of the fuel injectors.

4. A fuel injection control and drive circuit for an electrically operated fuel injector as set forth in claim 3 wherein at least some of the fuel injectors are provided with a separate direct electrical connection to the battery.

5. A fuel injection control and drive circuit for an electrically operated fuel injector as set forth in claim 4 wherein the associated engine has cylinder banks and a separate electrical battery connection is provided for the fuel injectors of each bank.

* * * * *